US006519887B1

(12) United States Patent
Allen et al.

(10) Patent No.: US 6,519,887 B1
(45) Date of Patent: Feb. 18, 2003

(54) MAGAZINE SAFETY

(75) Inventors: Scott F. Allen, Easton, ME (US); Pardip K. Vaid, Northampton, MA (US)

(73) Assignee: Smith & Wesson Corp., Springfield, MA (US)

( * ) Notice: Subject to any disclaimer, the term of this patent is extended or adjusted under 35 U.S.C. 154(b) by 3 days.

(21) Appl. No.: 09/745,460

(22) Filed: Dec. 21, 2000

(51) Int. Cl.[7] ..... F41A 17/38
(52) U.S. Cl. ..... 42/70.02; 42/70.01
(58) Field of Search ..... 42/70.02, 71.01, 42/75.01, 71.02

(56) References Cited

U.S. PATENT DOCUMENTS

| | | | | |
|---|---|---|---|---|
| 2,296,998 | A | * | 9/1942 | Koehler |
| 4,031,648 | A | | 6/1977 | Thomas |
| 4,291,481 | A | | 9/1981 | Hillberg |
| 4,428,138 | A | * | 1/1984 | Seecamp |
| 4,619,062 | A | * | 10/1986 | Johnson |
| 5,225,612 | A | * | 7/1993 | Bernkraut |
| 5,388,362 | A | * | 2/1995 | Melcher |
| 5,438,784 | A | | 8/1995 | Lenkarski et al. |
| 5,570,527 | A | * | 11/1996 | Felicci |
| 5,704,153 | A | | 1/1998 | Kaminski et al. |
| 5,815,973 | A | * | 10/1998 | Hochstrate |
| 5,974,717 | A | * | 11/1999 | Brooks ..... 42/70.02 |
| 6,240,669 | B1 | * | 6/2001 | Spaniel et al. |
| 6,253,479 | B1 | * | 7/2001 | Fuchs et al. |
| 6,412,207 | B1 | * | 7/2002 | Crye et al. |

FOREIGN PATENT DOCUMENTS

| | | | |
|---|---|---|---|
| CH | 648405 | * | 3/1985 |
| DE | 0634577 | * | 8/1936 |
| FR | 0795210 | * | 9/1936 |
| FR | 46883 | * | 10/1936 |
| GB | 0151196 | * | 9/1920 |
| GB | 0291747 | * | 11/1928 |
| GB | 291747 | * | 11/1928 |

* cited by examiner

*Primary Examiner*—Michael J. Carone
*Assistant Examiner*—Troy Chambers
(74) *Attorney, Agent, or Firm*—McCormick, Paulding & Huber LLP

(57) ABSTRACT

A magazine safety for a semi-automatic firearm having a frame, a magazine well, a magazine, and a firing mechanism is provided. The firing mechanism includes a trigger bar and a sear. The magazine safety includes a rod slidably mounted relative to the frame, and a rod biasing spring that acts on the rod and the frame. When the magazine is removed from the magazine well, the rod is biased into engagement with the trigger bar by the rod biasing spring. The rod holds the trigger bar in a "safety-engaged" position where it is out of alignment with the sear, thereby preventing actuation of the firearm. Inserting the magazine completely into the magazine well causes the rod to move thereby enabling the trigger bar to align with the sear and permit actuation of the firearm.

9 Claims, 2 Drawing Sheets

MAGAZINE SAFETY

BACKGROUND OF THE INVENTION

1. Technical Field

This invention relates to firearms in general, and to magazine safeties for firearms in particular.

2. Background Information

Semi-automatic pistols typically include an ammunition magazine disposed in the handle portion of the pistol's frame. Rounds of ammunition stored in the magazine are individually fed from the magazine into a barrel, where each round is fired. The magazine can be manually installed and removed from the firearm by the operator. Many gun manufacturers offer firearms that include a magazine safety that prevents the firearm from being fired if the magazine is not fully received within the magazine well. The magazine safety is principally designed to provide an additional safety mechanism to ensure that the firearm is safe regardless of whether the magazine is installed within the firearm or removed from the firearm.

DISCLOSURE OF THE INVENTION

According to the present invention, a magazine safety for a semi-automatic firearm having a frame, a magazine well, a magazine, and a firing mechanism is provided. The firing mechanism includes a trigger bar and a sear. The magazine safety includes a rod slidably mounted relative to the frame, and a rod biasing spring that acts on the rod and the frame. When the magazine is removed from the magazine well, the rod is biased into engagement with the trigger bar by the rod biasing spring. The rod holds the trigger bar in a "safety-engaged" position where it is out of alignment with the sear, thereby preventing actuation of the firearm. Inserting the magazine completely into the magazine well causes the rod to move thereby enabling the trigger bar to align with the sear and permit actuation of the firearm.

An advantage of the present invention is that the operating safety of the firearm is appreciably enhanced. The present invention safety provides an additional safety to ensure that the firearm is safe regardless of whether the magazine is installed within the firearm or removed from the firearm. A further advantage of the present invention is that the magazine safety is automatically engaged when the magazine is removed from the magazine well.

These and other objects, features, and advantages of the present invention will become apparent in light of the detailed description of the present invention.

DETAILED DESCRIPTION OF THE INVENTION

Figure 1:
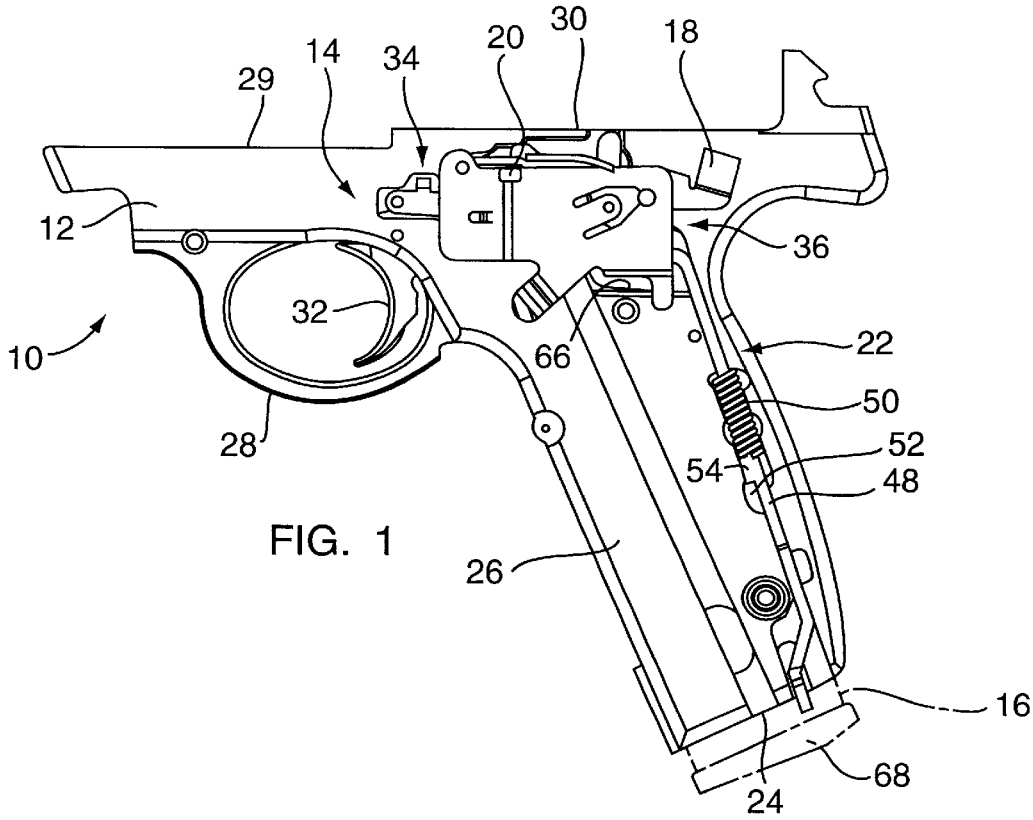
FIG. 1 is a diagrammatic assembly of a semi-automatic firearm partially sectioned, with the magazine removed and the present invention magazine safety in the engaged position.

Referring to FIG. 1, a semi-automatic firearm 10 includes a frame 12, a firing mechanism 14, a slide assembly (not shown), a barrel assembly (not shown), a magazine 16 (shown in phantom, partially ejected), a manual safety 18, a slide stop 20, and a magazine safety 22. The frame 12 includes a magazine well 24 for receiving the magazine 16, a handle portion 26, a trigger guard 28, a barrel seat 29, and a pair of slide guide rails 30. The magazine well 24 is disposed in the handle portion 26. The slide guide rails 30 support and guide the slide assembly along the frame 12.

The firing mechanism 14 includes a pivotally mounted trigger 32, a trigger spring (not shown), a trigger bar 34, and a primer contacting mechanism 36. The trigger bar operably connects the trigger 32 and the primer contacting mechanism 36 such that actuating the trigger 32 under normal unsafe operating conditions causes the primer contacting mechanism 36 to be actuated. The primer contacting mechanism 36 can be any mechanism actuable by a trigger bar 34 that directly or indirectly causes the round of ammunition residing within the barrel to be fired. Primer contacting mechanisms 36 include, but are not limited to, hammer-type and striker pin-type percussion assemblies. The present invention magazine safety 22 can also be used with firearms that utilize a trigger bar with an electronic type firing mechanism. In the embodiment shown in FIGS. 1–3, the primer contacting mechanism 36 is a hammer-type that includes a sear 38 (see FIGS. 2 and 3) having a sear arm 40 for engagement with the trigger bar 34. The trigger bar 34 is pivotally mounted at a forward end 42, and includes a hook-shaped catch 44 at its opposite end for engagement with the sear arm 40. The trigger spring biases the trigger bar 34 toward the sear arm 40 in the direction shown by arrow 46.

Figure 2:
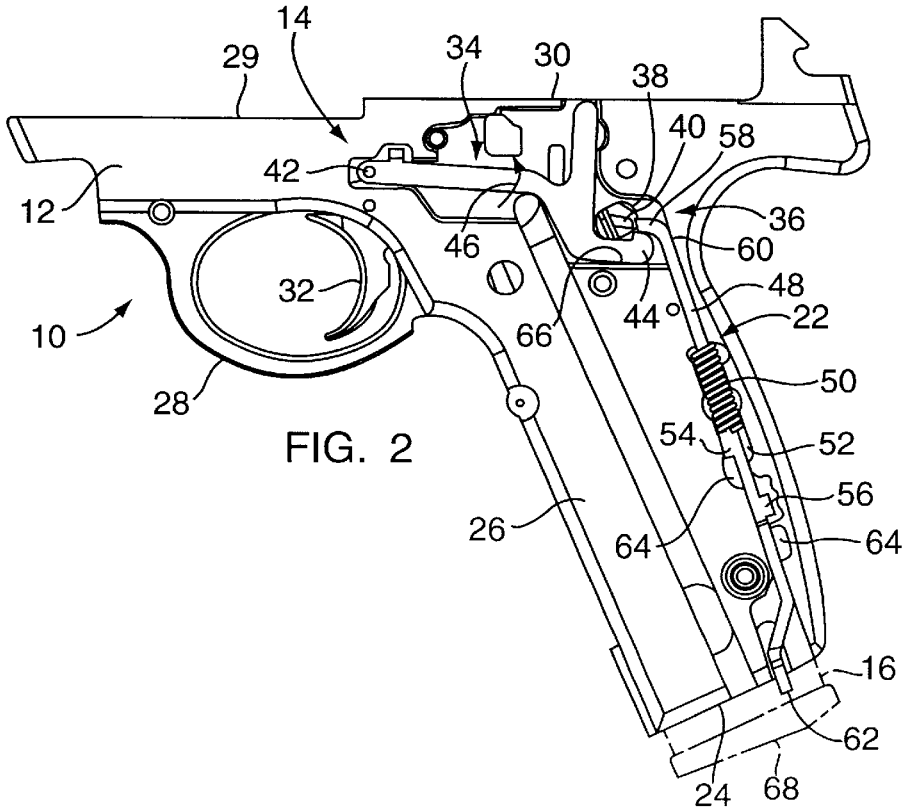
FIG. 2 is the diagrammatic view of the semi-automatic firearm shown in FIG. 1, with the manual safety and the slide stop removed, to more fully show the present magazine safety.
Figure 3:
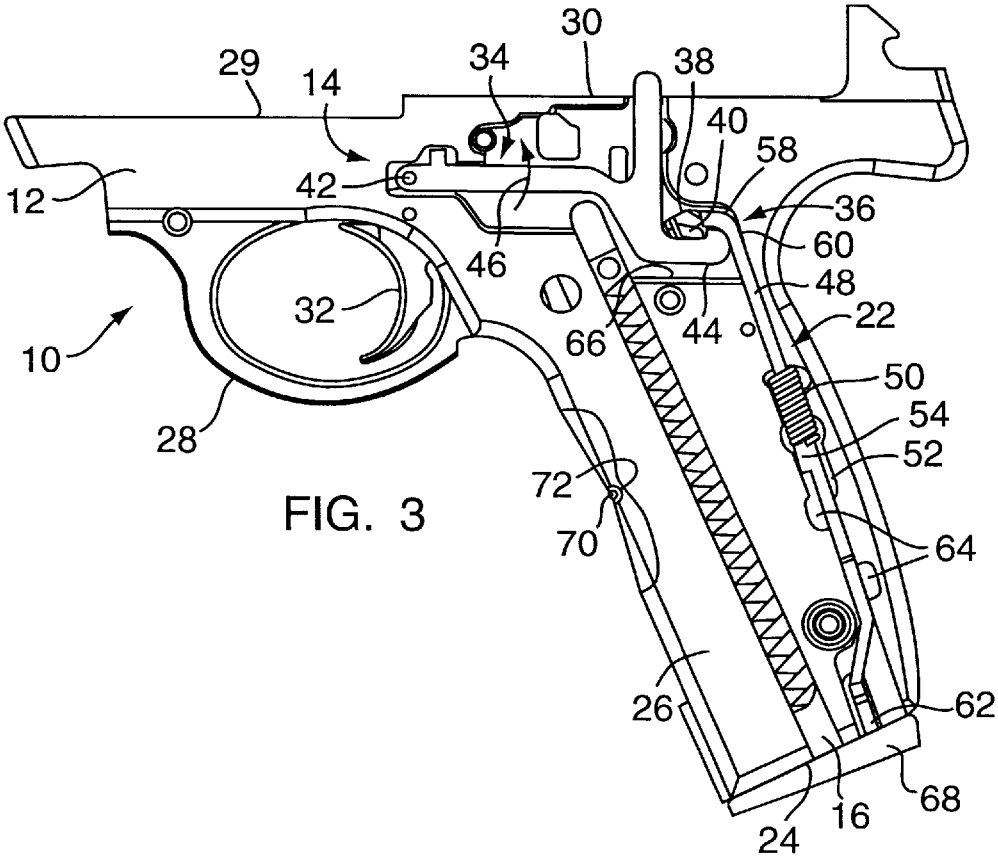
FIG. 3 is a diagrammatic assembly of a semi-automatic firearm partially sectioned, with the magazine installed and the present invention magazine safety in the disengaged position.

Referring to FIGS. 1–3, the magazine safety 22 includes a rod 48 and a rod biasing spring 50. In the most preferred embodiment, the rod 48 is slidably mounted within a channel 52 disposed in the outer surface of the handle portion 26 of the frame 12. The rod 48 includes first guide tab 54, a second guide tab 56, a flange 58, a first end 60, and a second end 62. The flange 58 is attached to the first end 60. The first and second guide tabs 54,56 are mounted on opposing sides of the rod 48. Slots 64 are disposed on opposite walls of the channel 52, positioned to receive the first and second guide tabs 54,56. The rod 48 is received within the rod biasing spring 50 and the relative positions of the rod 48 and the spring 50 are such that one end of the spring 50 acts on one or both of the guide tabs 54,56, and the opposite end of the spring 50 acts on the frame 12. The first end 60 of the rod 48 is positioned to enable engagement between the flange 58 and the trigger bar 34. The second end 62 of the rod 48 extends a distance through the heel of the handle portion 26. In alternative embodiments, the magazine safety 22 may include a linkage operably disposed between the trigger bar 34 and the rod 48. The linkage can be used, for example, to gain mechanical advantage and/or to change the direction the trigger bar 34 is being actuated by the safety 22.

Referring to FIGS. 1 and 2, when the magazine 16 is removed from the magazine well 24, the rod 48 is biased into a "safety-engaged" position by the rod biasing spring 50. In the safety-engaged position, the second end 62 of the rod 48 extends a distance through the heel of handle portion 26, and the flange 58 attached to the first end 60 of the rod 48 is in contact with the hook-shaped catch 44 of the trigger bar 34 (see FIG. 2). The flange 58 holds the trigger bar catch 44 against a stop 66, out of alignment with the sear arm 40. The rod biasing spring 50 provides the force necessary to overcome the trigger spring and rotate the trigger bar 34 out of alignment with the sear arm 40, against the stop 66. Actuation of the trigger 32 in the safety-engaged position causes the hook-shaped catch 44 of the trigger bar 34 to slide along the flange 58. The misalignment between the sear arm 40 and the trigger bar 34 prevents the trigger bar 34 from actuating the sear 38 and primer contacting mechanism 36, and therefore prevents actuation of the firearm 10.

Referring to FIG. 3, when the magazine 16 is inserted a distance into the magazine well 24, the butt plate 68 of the magazine 16 contacts the second end 62 of the rod 48. Complete insertion of the magazine 16 causes the butt plate 68 to push the rod 48 a distance within the channel 52, consequently compressing the rod biasing spring 50. At the same time, the rod flange 58 moves away from the sear arm 40, thereby enabling the trigger bar 34 to rotate toward the sear arm 40. The trigger spring acting on the trigger bar 34 provides the force necessary to rotate the trigger bar 34 toward the sear arm 40. When the magazine 16 is completely inserted into the magazine well 24, the hook-shaped catch 44 of the trigger bar 34 is aligned with sear arm 40 and the magazine safety 22 is in a "safety-disengaged" position. In the safety-disengaged position, actuation of the trigger 32 and consequent translation of the trigger bar 34 causes the hook-shaped catch 44 to engage and move the sear arm 40. Unless otherwise prevented, movement of the sear arm 40 results in actuation of the primer contacting mechanism 36, and therefore operation of the firearm 10.

Referring to FIGS. 1 and 2, when the magazine 16 is released from firearm 10, the rod biasing spring 50 overcomes the trigger bar spring and forces the rod 48 downward. In doing so, the rod 48 forces the magazine 16 to eject a distance out of the magazine well 24. At the same time, the flange 58 moves downward and contacts the trigger bar catch 44, causing the trigger bar 34 to rotate out of alignment with the sear arm 40; i.e., back into the safety-engaged position described above.

Referring to FIG. 3, an additional advantage provided by the present invention is that it also acts as a magazine ejection mechanism that can be used alone, or in combination with other magazine ejection mechanisms. The magazine 16 is held in place by a spring-loaded tab 70 that extends into a detent 72 disposed in the side of the magazine 16 when the magazine 16 is fully inserted into the magazine well 24. When the spring-loaded tab 70 is released from the detent 72, the rod biasing spring 50 acting through the rod 48 in contact with the butt plate 68 ejects the magazine 16 a distance out of the magazine well 24.

Although this invention has been shown and described with respect to the detailed embodiments thereof, it will be understood by those skilled in the art that various changes in form and detail thereof may be made without departing from the spirit and scope of the invention.

What is claimed is:

1. A magazine safety for a semi-automatic firearm having a frame, a magazine well, a magazine, and a firing mechanism that includes a trigger bar and a sear, said magazine safety comprising:

a channel disposed in the magazine well, the channel having one or more slots disposed therein;

a rod slidably mounted within said channel relative to said frame, the rod having one or more tabs attached thereto;

wherein said one or more tabs received with said one or more slots, retain said rod within said channel; and wherein when said magazine is selectively removed from and inserted into said magazine well, said rod is positioned between a safety-engaged and a safety disengaged position.

2. The magazine safety for a semi-automatic firearm of claim 1 having a frame, a magazine well, a magazine, a firing mechanism and a trigger bar, said magazine safety comprising:

a rod slidably mounted relative to said frame;

a rod biasing member;

when said magazine is removed from said magazine well, said rod is biased into engagement with said trigger bar by said rod biasing member, thereby moving and retaining said trigger bar out of alignment with said firing mechanism and preventing actuation of said firing mechanism via said trigger bar; and wherein inserting magazine completely into said magazine well causes said rod to disengage from said trigger bar thereby enabling said trigger bar to align with said firing mechanism to permit actuation of said firing mechanism via said trigger bar.

3. A magazine safety for a semi-automatic firearm having a frame, a magazine well, a magazine, and a firing mechanism that includes a trigger bar and a sear, said magazine safety comprising:

a channel disposed in the magazine well, the channel having one or more slots disposed therein;

a rod slidably mounted within said channel relative to said frame, the rod having one or more tabs attached thereto; and a rod biasing spring;

wherein said one or more tabs received with said one or more slots, retain said rod within said channel;

wherein when said magazine is removed from said magazine well, said rod is biased into engagement with said trigger bar by said rod biasing spring, and maintains said trigger bar out of alignment with said sear, thereby preventing actuation of said firearm;

wherein inserting said magazine completely into said magazine well, causes said rod to move thereby enabling said trigger bar to align with said sear and permit actuation of said firearm.

4. The safety of claim 3, wherein said rod is received within said rod biasing spring and said rod biasing spring acts on at least one of said one or more tabs and on said frame.

5. The safety of claim 3, wherein said rod comprises a first end and a second end, and a flange attached to said first end, and said flange engages said trigger bar.

6. A semi-automatic firearm, comprising:

a firing mechanism having a trigger, a trigger bar, and a sear;

a magazine;

a frame with a magazine well for receiving said magazine;

a channel disposed in the magazine well a magazine safety that includes a rod slidably mounted within said channel, a rod biasing spring, and a means for retaining said rod within said channel;

wherein when said magazine is removed from said magazine well, said rod is biased into engagement with said trigger bar by said rod biasing spring, and maintains said trigger bar out of alignment with said sear, thereby preventing actuation of said firearm;

wherein inserting said magazine completely into said magazine well, causes said rod to move thereby enabling said trigger bar to align with said sear and permit actuation of said firearm.

7. The firearm of claim 6, wherein one or more tabs are attached to said rod, and one or more slots are disposed in said channel;

wherein said one or more tabs are received with said one or more slots, thereby retaining said rod within said channel.

8. The firearm of claim 7, wherein said rod is received within said rod biasing spring and said rod biasing spring acts on at least one of said one or more tabs and on said frame.

9. The firearm of claim 8, wherein said rod comprises a first end and a second end, and a flange attached to said first end, and said flange engages said trigger bar.

* * * * *